US006058279A

United States Patent [19]

Folkins

[11] Patent Number: 6,058,279

[45] Date of Patent: May 2, 2000

[54] NON-FUSER APPARATUS CUSTOMER REPLACEABLE UNIT INCLUDING A FUSER RELEASE AGENT SUPPLY ASSEMBLY

[75] Inventor: Jeffrey J. Folkins, Rochester, N.Y.

[73] Assignee: Xerox Corporation, Stamford, Conn.

[21] Appl. No.: 09/325,856

[22] Filed: Jun. 4, 1999

[51] Int. Cl.[7] ..... G03G 15/00; G03G 15/20

[52] U.S. Cl. ..... 399/110; 399/122; 399/325

[58] Field of Search ..... 399/325, 324, 399/122, 110, 111, 107, 307, 320; 118/DIG. 1, 60; 219/216

[56] References Cited

U.S. PATENT DOCUMENTS

| | | | |
|---|---|---|---|
| 3,291,466 | 12/1966 | Aser et al. | 219/216 X |
| 3,981,269 | 9/1976 | Watahiki | 118/60 |
| 5,212,527 | 5/1993 | Fromm et al. | 399/326 |
| 5,356,473 | 10/1994 | Fromm | 118/60 |
| 5,504,566 | 4/1996 | Chow et al. | 399/320 |
| 5,956,547 | 9/1999 | Kamei et al. | 399/122 |

*Primary Examiner*—Sophia S. Chen
*Attorney, Agent, or Firm*—Tallam I. Nguts

[57] ABSTRACT

A non-fuser apparatus Customer Replaceable Unit (CRU) is provided for use in a toner powder marking technology reproduction machine including a fuser apparatus for fusing toner images. The CRU includes a housing having an external surface contoured for inserting into a CRU cavity within the reproduction machine, and elements of the reproduction machine, not including the fuser apparatus, requiring occasional. The CRU importantly includes a fuser release agent supply assembly connected to the housing thereof for supplying fuser release agent to the fuser apparatus. The fuser release agent supply assembly includes an agent reservoir located within the housing for containing fuser release agent, and an openable access door formed through a portion of the housing into the agent reservoir for releasing fuser release agent from the reservoir.

7 Claims, 5 Drawing Sheets

NON-FUSER APPARATUS CUSTOMER REPLACEABLE UNIT INCLUDING A FUSER RELEASE AGENT SUPPLY ASSEMBLY

BACKGROUND OF THE INVENTION

This invention relates generally to electrophotographic printing machines having heat and pressure fusers, and more particularly to such a machine having a non-fuser apparatus customer replaceable unit including a fuser release agent supply assembly.

In a typical electrophotographic printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules either to a donor roll or to a latent image on the photoconductive member. The toner attracted to a donor roll is then deposited on a latent electrostatic images on a charge retentive surface which is usually a photoreceptor. The toner powder image is then transferred from the photoconductive member to a copy substrate. The toner particles are heated to permanently affix the powder image to the copy substrate or support member.

In order to fix or fuse the toner material onto a support member permanently by heat, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is heated. During operation of a fusing system of this type, the support member to which the toner images are adhered is moved through the nip formed between the rolls with the toner image contacting the heated fuser roll to thereby effect heating of the toner images within the nip.

The heated fuser roll is usually the roll that contacts the toner images on a substrate such as plain paper. In any event, the roll contacting the toner images is usually provided with material for preventing toner offset to the fuser member. Three materials which are commonly used for such purposes are PFA™, Viton™ and silicone rubber. All of these materials, in order to maintain their adhesive qualities, require release agents specific to the material.

Various methods are known for applying release agent materials to a fuser member such as a heated fuser roll. One such system comprises a Release Agent Management (RAM) system including a donor roll which contacts the fuser member to which the oil or release agent material is applied. The donor roll also contacts a metering roll which conveys the oil from a supply of oil to the donor roll. A blade member is provided for metering oil on the metering roll.

In low volume or desktop printers, critical machine features involve the cost and the quantity as well as the duration of required customer service operations. It is advantageous therefore to attempt to keep the number of separate customer replaceable or serviceable units to a minimum, preferably to only one.

Additionally, in such printers, (especially color ones) where a RAM system is required for reliable fuser operation, differences in service intervals among the different parts or elements of the machine and of the fuser or fusing apparatus of the printer, present service and cost effectiveness problems. For example, the rolls of the fusing apparatus may be projected to last between 50 k–100 k copies or imprints. However, the oil or release agent supply of the RAM system for the fusing apparatus is ordinarily not likely to be able to make this type of life (between 50 k–100 k copies or imprints).

This is particularly so because the customer handling requirements for the fusing apparatus (i.e. small size and low cost) usually would not allow room or capacity for carrying the approximately one liter of oil or release agent required to make the 50–100 k life. Such room or capacity requirements are made even worse if the oil or release agent must be saturated in a wick in order to facilitate low cost handling and effective sealing within a customer replaceable unit. Ordinarily, such room and capacity requirements would generally result in the use of an undesirable separate oil or release agent supply customer replaceable unit, in multiple refilling operations, for example, at frequent intervals of about 10 k copies or imprints.

Following is a discussion of prior art, incorporated herein by reference, which may bear on the patentability of the present invention. In addition to possibly having some relevance to the question of patentability, these references, together with the detailed description to follow, may provide a better understanding and appreciation of the present invention.

U.S. Pat. No. 5,504,566 granted to Chow et al on Apr. 2, 1996 discloses an apparatus for fusing toner images to a substrate. A Release Agent Management (RAM) system for applying silicone oil to a metering roll utilizes a pair of metering blades to improve oil uniformity on the metering roll. Thus, streaks or localized areas of excess silicone oil as the result of blade defects and/or dirt accumulation associated with a first blade, are metered or smoothed to a more uniform thickness by the second blade. To this end, the first metering blade serves to meter silicone oil to a first predetermined thickness while the second blade serves to meter oil streaks to a second predetermined thickness which is greater than the first predetermined thickness.

U.S. Pat. No. 5,212,527 granted to Fromm et al on May 18 discloses a release agent management (RAM) system including a metering roll supported for contact with release agent material contained in a sump. A donor roll is provided for applying oil deposited thereon by the metering roll. A metering blade structure for metering silicone oil onto the metering roll has two modes of operation. In one mode, a wiping action of a metering blade meters a relatively large quantity of silicone oil to the roll surface for accommodating the fusing of color toner images. In another mode of operation, a doctoring action is effected for metering a relatively small amount of silicone oil to the roll surface for accommodating the fusing of black toner images.

BRIEF SUMMARY OF THE INVENTION

According to one aspect of the present invention there is provided a non-fuser apparatus Customer Replaceable Unit (CRU) for use in a toner powder marking technology reproduction machine including a fuser apparatus for fusing toner images. The CRU includes a housing having an external surface contoured for inserting into a CRU cavity within the reproduction machine, and elements of the reproduction machine, not including the fuser apparatus, requiring occasional. The CRU importantly includes a fuser release agent supply assembly connected to the housing thereof for supplying fuser release agent to the fuser apparatus. The fuser release agent supply assembly includes an agent reservoir located within the housing for containing fuser release agent, and an openable access door formed through a portion of the housing into the agent reservoir for releasing fuser release agent from the reservoir.

DETAILED DESCRIPTION OF THE INVENTION

Figure 1:
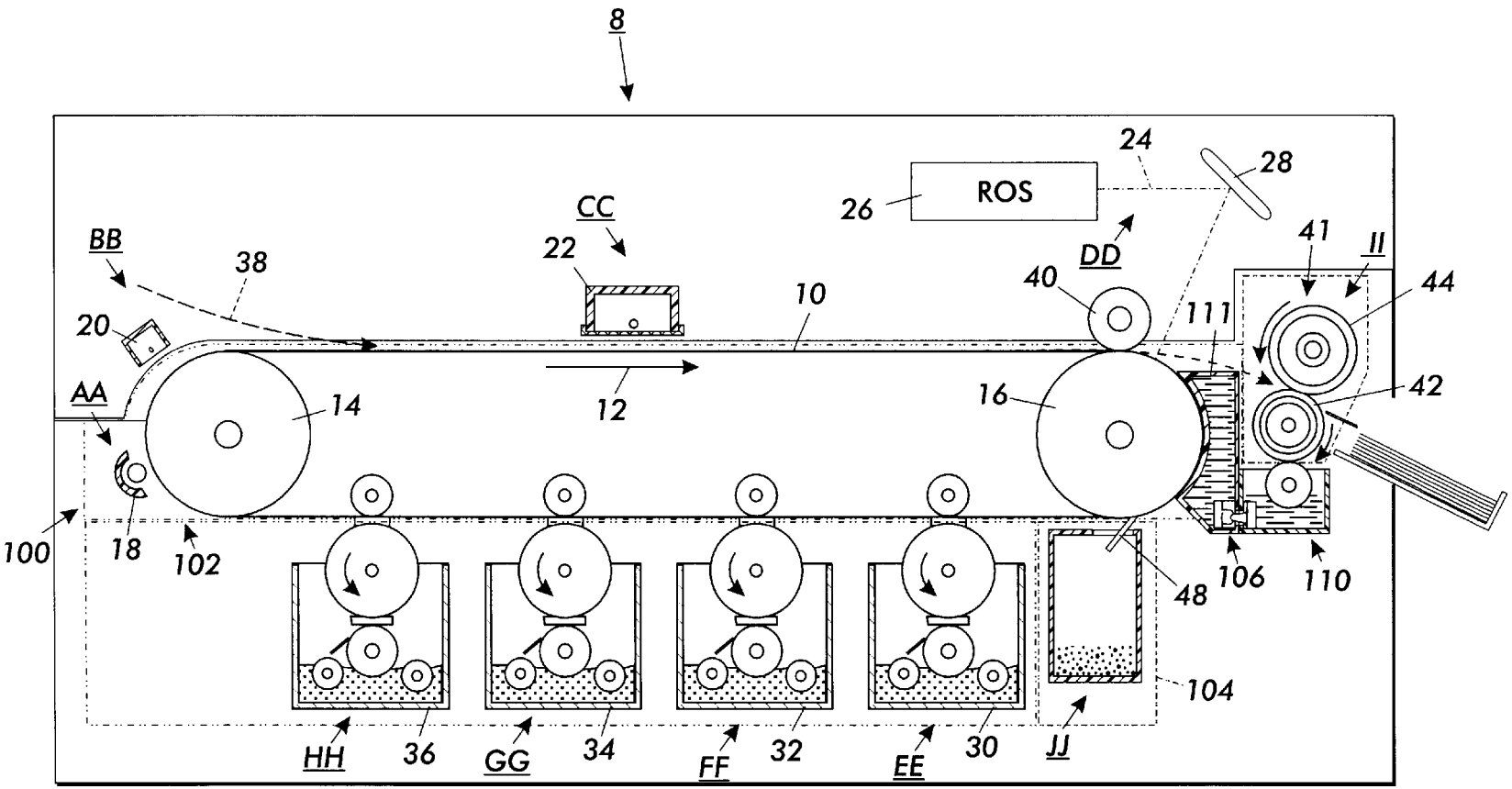
FIG. 1 is a schematic representation of a toner powder marking technology reproduction machine such as an electrostatographic reproduction machine including the Customer Replaceable Unit (CRU) of the present invention.
Figure 2:
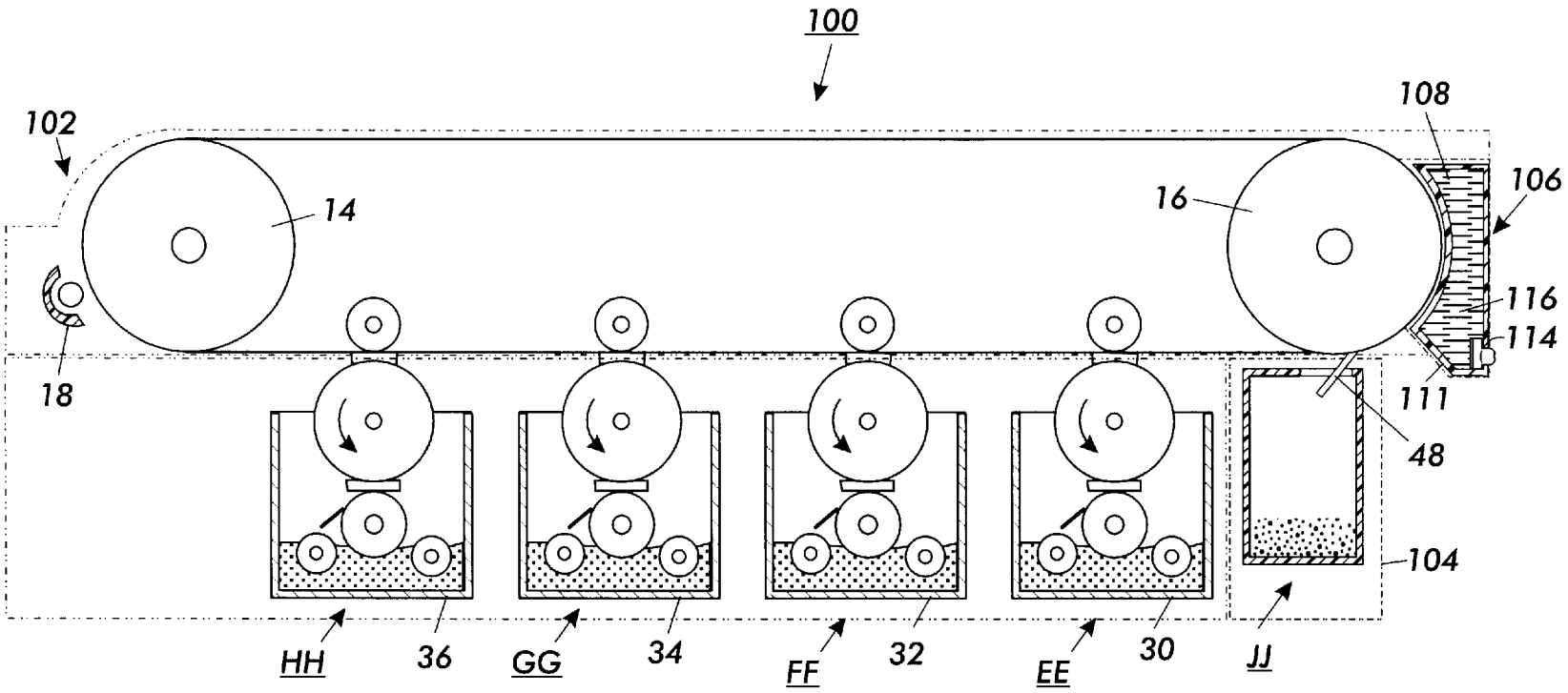
FIG. 2 is a schematic of the CRU of FIG. 1 as part of a RAM system for use with the heat and pressure fuser apparatus of the machine of FIG. 1.
Figure 3:
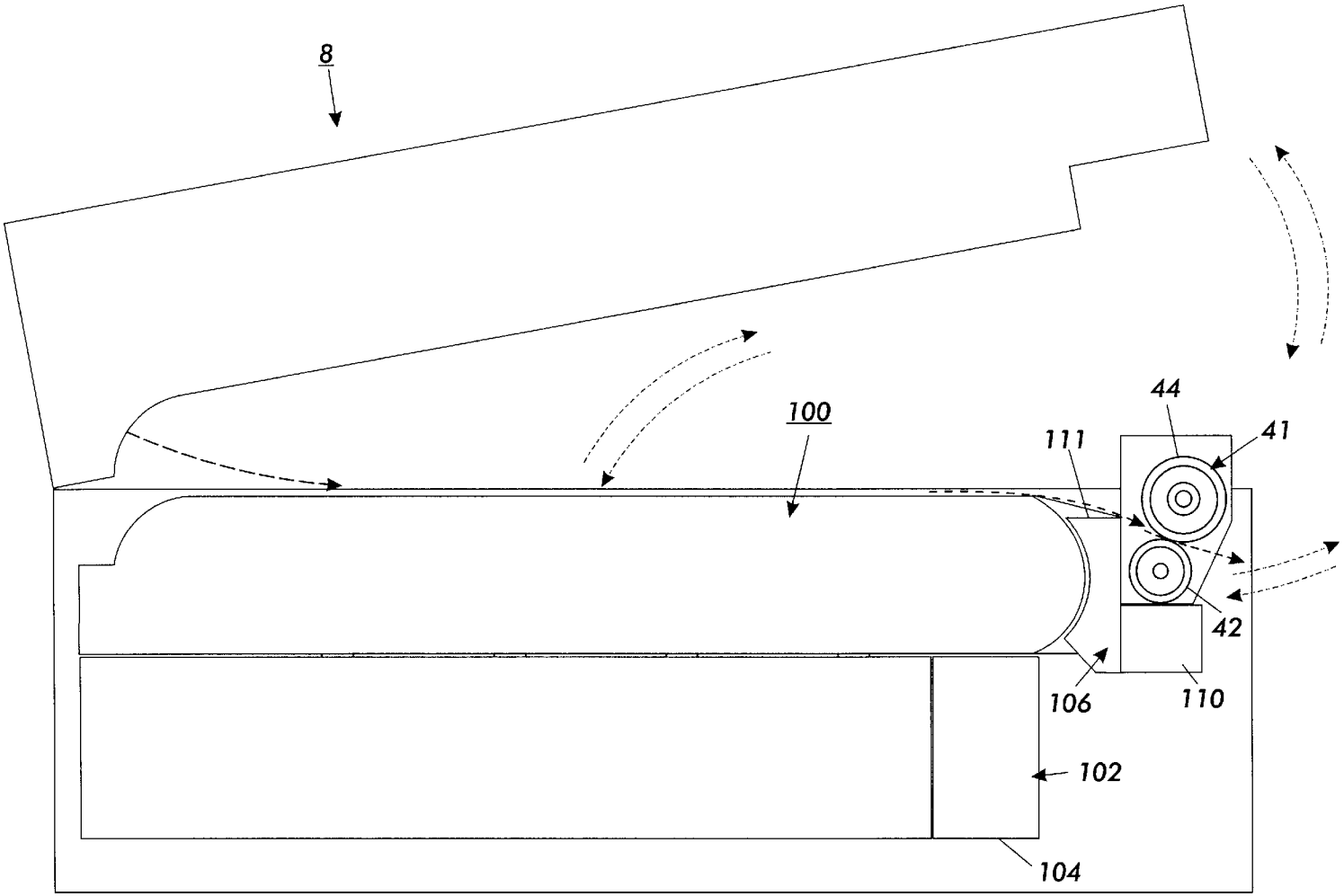
FIG. 3 is an outline schematic of the machine of FIG. 1 including a CRU that contains part of a RAM system for use with the heat and pressure fuser apparatus of the machine of FIG. 1.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims. For example, the present invention is intended to cover a variety of printing technologies and not just electrophotographic printers. Ionographic, Direct dry powder marking or any other marking technology which utilizes dry toner particles which need to be fused are relevant to the present invention. For a general understanding of the features of the present invention, reference is made to the drawings. In the drawings, like reference numerals have been used throughout to identify identical elements.

FIG. 1 illustrates a toner powder marking technology reproduction machine, for example, a color electrophotographic printing machine 8 which is suitable for implementing the principles of the present invention. The printing machine 8 includes a main customer replaceable unit (CRU) that includes at least one nonfuser apparatus machine element, for example, a photoreceptor CRU of the present invention shown generally as 100. As shown, the CRU 100 includes a frame 102 that has an outer surface 104 contoured for insertion into a cavity (not labeled) within the machine 8.

The CRU 100 may have anyone or several non-fuser apparatus electrostatographic process elements of the machine including charging elements, erase elements, development elements, a photoreceptor belt or drum, and importantly the life-extending fuser release agent or oil supply assembly 106 of the present invention. For example, the CRU 100 as shown includes an Active Matrix (AMAT) photoreceptor belt 10 which is driven and travels in the direction indicated by the arrow 12 when loaded into the machine 8. Belt travel is brought about by mounting the belt about a drive roller 14 (which is driven by a motor not shown) and a tension roller 16.

As the photoreceptor belt travels each part of it passes through each of the subsequently described process stations and elements. For convenience, a single section of the photoreceptor belt, referred to as the image area, is identified. The image area is that part of the photoreceptor belt which is to receive the various toner layers which, after being transferred and fused to a substrate, produce the final color image. While the photoreceptor belt may have numerous image areas since each image area is processed in the same way a description of the processing of one image area suffices to fully explain the operation of the printing machine.

The machine 8 is for example a top transfer color machine in which the production of a color document takes place in 5 cycles. The first cycle begins with the image area passing through an erase station AA. At the erase station AA an erase lamp 18 illuminates the image area so as to cause any residual charge which might exist on the image area to be discharged. Such erase lamps and their use in erase stations are well known. Light emitting diodes are commonly used as erase lamps.

As the photoreceptor belt continues its travel the image area passes through a first charging station BB. At the first charging station BB a corona generating device 20, beneficially a DC pin corotron, charges the image area to a relatively high and substantially uniform potential of, for example, about −700 volts. After passing the corona generating device 20 the image area passes through a second charging station CC which partially discharges the image area to, for example, about −500 volts. The second charging station CC uses an AC scorotron 22 to generate the required ions.

The use of a first charging station to overcharge the image area and a subsequent second charging station to neutralize the overcharge is referred to as split charging. Since split charging is beneficial for recharging a photoreceptor which already has a developed toner layer, and since the image area does not have such a toner layer during the first cycle, split charging is not required during the first cycle. If split charging is not used in the first cycle either the corona generating device 20 or the scorotron 22 corona could be used to simply charge the image area to the desired level of −500 volts.

After passing through the second charging station CC the now charged image area passes through an exposure station DD. At the exposure station DD the charged image area is exposed to the output 24 of a laser based output scanning device 26 and which reflects from a mirror 28. During the first cycle the output 24 illuminates the image area with a light representation of a first color (say black) image. That light representation discharges some parts of the image area so as to create an electrostatic latent representation of the exposing light. For example, illuminated sections of the image area might be discharged by the output 24 to about −50 volts. Thus after exposure the image area has a voltage profile comprised of relatively high voltages of about −500 volts and of relatively low voltages of about −50 volts. After passing through the exposure station DD the exposed image area passes through a first development station EE which deposits a first color of negatively charged toner 30, black, onto the image area.

While the first development station could be a magnetic brush developer, a scavengeless developer may be somewhat better. One benefit of scavengeless development is that it does not disturb previously deposited toner layers. Since during the first cycle the image area does not have a previously developed toner layer, the use of scavengeless development is not absolutely required as long as the developer is physically cammed away during other cycles. However, since the other development station (described below) use scavengeless development it may be better to use scavengeless development at each development station.

After passing through the first development station EE, the image area advances so as to return to the first charging station BB. The second cycle begins. The first charging station BB uses its corona generating device 20 to overcharge the image area and its toner to more negative voltage levels than that which the image area and its first toner layer are to have when they are exposed. At the second charging station CC the AC scorotron 22 reduces the negative charge on the image area by applying positive ions so as to charge the image area.

After passing through the second charging station CC the now substantially uniformly charged image area with its first toner layer advances to the exposure station DD. At the exposure station DD the recharged image area is again exposed to the output 24 of a laser based output scanning device 26. During this cycle the scanning device 26 illuminates the image area with a light representation of a second color (say yellow) image. That light representation discharges some parts of the image area so as to create a second electrostatic latent representation. After passing through the exposure station DD the now exposed image area passes through a second development station FF which deposits a second color of toner 32, yellow, onto the image area. Since the image area has a first toner layer the second development station FF should be a scavengeless developer.

After passing through the second development station FF the image area and its two toner layers returns to the first charging station BB. The third cycle begins. The first charging station BB again uses its corona generating device 20 to overcharge the image area and its two toner layers to more negative voltage levels than that which the image area and its two toner layer are to have when they are exposed. The second charging station CC again reduces the image area potentials. The substantially uniformly charged image area with its two toner layers then advances again to the exposure station DD. At exposure station DD the image area is again exposed to the output 24 of the laser based output scanning device 26. During this cycle the scanning device 26 illuminates the image area with a light representation of a third color (say magenta) image. That light representation discharges some parts of the image area so as to create a third electrostatic latent representation.

After passing through the exposure station DD the third time the image area passes through a third development station GG. The third development station GG, preferably a scavengeless developer, advances a third color of toner 34, magenta, onto the image area. The result is a third toner layer on the image area.

The image area with its three toner layers then advances back to the charging station BB. The fourth cycle begins. The first charging station BB once again uses its corona generating device 20 to overcharge the image area (and its three toner layers) to more negative voltage levels than that which the image area is to have when it is exposed (say about −500 volts). The second charging station CC once again reduces the image area potentials to about −500 volts. The substantially uniformly charged image area with its three toner layers then advances yet again to the exposure station DD. At the exposure station DD the recharged image area is again exposed to the output 24 of the laser based output scanning device 26. During this cycle the scanning device 26 illuminates the image area with a light representation of a fourth color (say cyan) image. That light representation discharges some parts of the image area so as to create a fourth electrostatic latent representation.

After passing through the exposure station DD the fourth time the image area passes through a fourth development station HH. The fourth development station, also a scavengeless developer, advances a fourth color of toner 36, cyan, onto the image area. This marks the end of the fourth cycle.

After completing the fourth cycle the image area has four toner powder images which make up a composite color powder image. That composite color powder image is comprised of individual toner particles which have charge potentials which vary widely. Indeed, some of those particles have a positive charge. Transferring such a composite toner layer onto a substrate would result in a degraded final image. Therefore it becomes necessary to prepare the charges on the toner layer for transfer.

The fifth cycle begins by passing the image area through the erase station AA. At erase station AA the erase lamp 18 discharges the image area to a relatively low voltage level. This reduces the potentials of the image area, including that of the composite color powder image, to potentials near zero. The image area with its composite color powder image then passes to the charging station BB. During the fifth cycle the charging station BB performs a pre-transfer charging function. The first charging device supplies sufficient negative ions to the image area that substantially all of the previously positively charged toner particles are reversed in polarity. Importantly, positive charges, which because of the polarities used in the subsequently described transfer are the most difficult to transfer, are also reduced to levels near zero.

As the image area continues in its travel past the first charging station BB a substrate 38 is advanced into place over the image area using a sheet feeder (which is not shown). As the image area and substrate continue their travel they pass through the charging station CC.

At charging station CC the second charging device 22 applies positive ions onto the exposed surface of the substrate 38. The positive ions attract the negatively charged toner particles on the image area to the substrate. As the substrate continues its travel the substrate passes a bias transfer roll 40 which assists in attracting the toner particles to the substrate and in separating the substrate with its composite color powder image from the photoreceptor belt 10.

The substrate 38 is then directed into a fuser or fusing apparatus 41 at fusing station 11 where a heated fuser roll 42 and a pressure roller 44 create a nip through which the substrate passes. The combination of pressure and heat at the nip causes the composite color toner image to fuse into the substrate 38. As shown, the fusing apparatus 41 includes a RAM system 110 of the present invention for applying fuser release oil or agent onto the surface of the fuser roll 42, in order to insure complete high quality release of the fused toner image onto the substrate 38. After fusing, a chute, not shown, guides the support sheets 38 to a catch tray, also not shown, for removal by an operator.

After the substrate is separated from the photoreceptor belt 10 the image area continues its travel and eventually enters a cleaning station JJ. At cleaning station JJ a cleaning blade 48 is brought into contact with the image area. That blade wipes residual toner particles from the image area. The image area then passes once again to the erase station AA and the 5 cycle printing process begins again. The various machine functions described above are generally managed and regulated by a controller which provides electrical command signals for controlling the operations described above.

Referring now to FIGS. 1–6, and particularly to FIGS. 2, and 4–6, the non-fuser apparatus customer Replaceable Unit (CRU) 100 of the present invention is illustrated in detail. The CRU 100 includes a frame 102 having an external surface 104 contoured for inserting into a CRU cavity (not labeled) within the toner marking technology machine, such as an electrostatographic reproduction machine 8. The CRU 100 also includes the photoreceptor or belt 10 mounted rotatably within the frame 102 for bearing latent and toner images formed thereon electrostatographically within the electrostatographic reproduction machine.

Importantly, the CRU 100 includes the fuser release oil or agent supply assembly 106 of the present invention that is formed as an integral part of the frame 102 for supplying fuser release oil 108 to the fuser or fusing apparatus 41 of the electrostatographic reproduction machine 8 as shown. The fuser release oil or agent supply assembly 106 includes a slanted bottom housing 111 defining an oil reservoir chamber 112, and forming part of the frame 102, for containing and effectively releasing fuser release oil or agent 108.

The fuser release oil or agent supply assembly 106 further includes a first oil holding wick 116 within the oil reservoir or chamber 112. The fuser release oil or agent supply assembly 106 also includes an openable and closeable access 114 formed through a portion of the housing 111 into the oil reservoir or chamber 112 for cooperating with a part 132 of the RAM system 110 to automatically release fuser release oil or agent 108 from the oil reservoir 112, after the CRU 100 is inserted into the electrostatographic reproduction machine 8.

Figure 4:
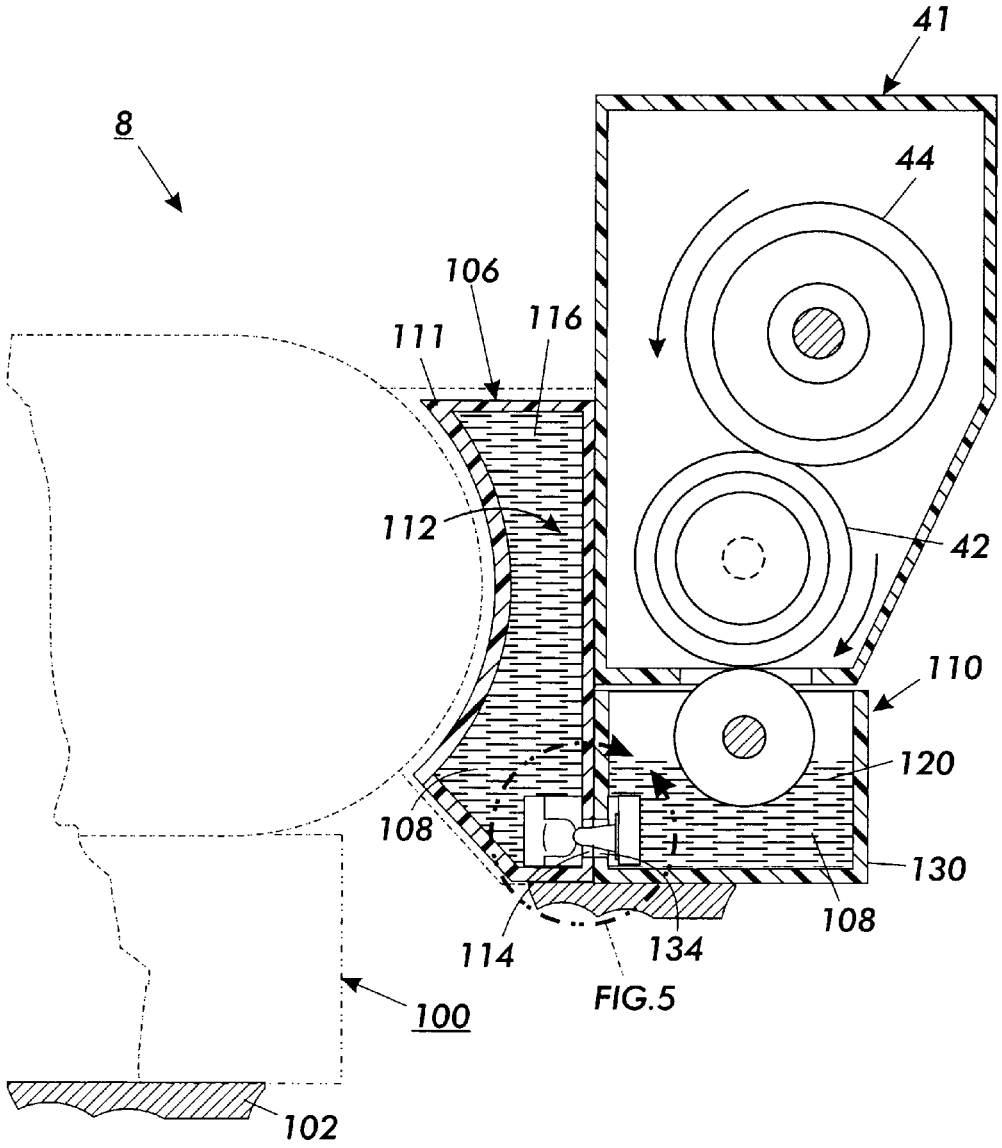
FIG. 4 is an enlarged portion of the machine of FIG. 1 showing the RAM system and CRU of the present invention.
Figure 5:
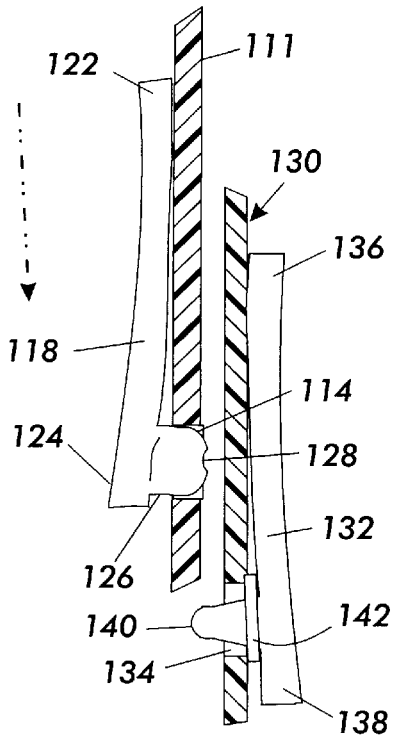
FIGS. 5–6 are detailed illustrations of an automatic opening and closing system for accesses into the fuser release agent reservoir and RAM container of the machine of FIG. 1 in accordance with the present invention.
Figure 6:
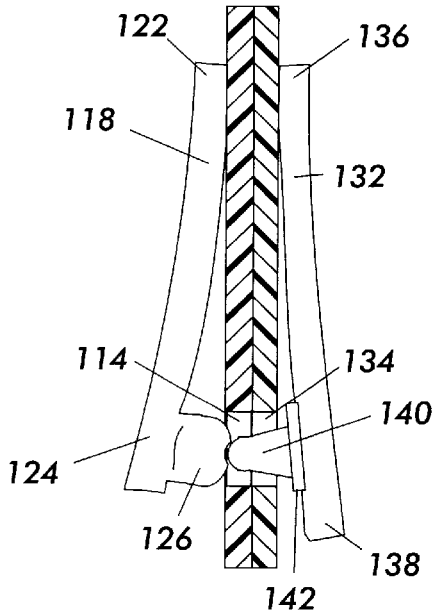

As illustrated in detail in FIGS. 4–6, the openable and closeable access 114 for example can be a trap door that is normally sealed by a first welded, live-hinge flat spring member 118. A first end, the top end 122 of the member 118 is welded and sealed against the inside of the housing 111, in a cantilevered manner above the openable access 114. As such, the lower end 124 thereof can be moved from its normal position (sealing the openable access 114) and away from the openable access 114 in order to open it. As shown, the lower end 124 thus has at least one knob or protuberance member 126 including an engageable detent portion 128 thereon that is engageable for moving the spring member 118 away from the openable access 114 (FIGS. 5 and 6). Preferably, the bottom end 124 of spring member 118 includes a plurality of the protuberance members 126.

For cooperating to move the spring member 118 away from the openable access 114, there is provided for example on the container 130, a second welded, live-hinge flat spring member 132 that normally seals an openable access 134. As shown, a first end, the top end 136 of the member 132 is welded and sealed against the inside of the container 132, in a cantilevered manner above the openable access 134. As such, the lower end 138 thereof can be moved from its normal position (sealing the openable access 134) and away from the openable access 134 in order to open it to let fresh fuser release agent or oil into the container.

As shown, the lower end 138 thereof thus has at least one key-like protuberance member 140 that is narrower than the openable access 134 so as to allow agent or oil flow even while within the access. As such it includes a seal member 142 at its base for sealing the openable access 132 when the spring member 132 is in its down and normal position. The tip of the key-like member 140 is pointed and projects beyond the container 130 for engaging the detent portion 128 of a corresponding knob member 126 on the spring member 118, thus cooperating to move the spring member 118 away from the openable access 114 (FIGS. 5 and 6), as well as the spring member 132 from the container access 134 (FIG. 6). Preferably, the bottom end 138 of spring member 132 includes a plurality of the key-like protuberance members 140. As such, when the CRU 100 is inserted into the machine 8, the openable and closeable accesses 114, 134 are automatically opened (FIGS. 5 and 6).

Similarly the seal on the CRU could be of a destructable type such that the operation of insertion of the CRU into the machine punctures the seal (e.g. paper like) and opens the path for the agent to flow within the access for the initial transfer of the fluid to the fuser internal reservoir.

One way to look at the present invention, is to see it as a portion 106 of the Release Agent Management (RAM) system 110 for a an electrostatographic reproduction machine 8 being included in a customer replaceable unit (CRU) 100 of the machine. Specifically, in a desktop size electrostatographic reproduction machine, the fuser release agent or oil reservoir is included in the main or photoreceptor CRU 100 of the machine. Advantageously, there will be no need for what would otherwise be required relatively high frequency replacement of depleted fuser release oil or agent during the life of the machine and of the photoreceptor CRU. Additionally, providing fuser release oil for the life of the machine can be accomplished without the need for an additional machine CRU. Depending on the particular machine architecture and CRU strategy, the CRU that holds the fuser release agent might be of a variety of types and does not necessarily have to include the photoreceptor. For example if a separate module for replacing toner waste from the cleaner subsystem, the cleaner itself or any other portion of the machine elements were designated for routine customer replacement, then the fuser release agent could be included therein with the same advantages of a reduction in needed customer replaceable units.

In low volume or desktop printers, critical machine features involve the cost and the quantity as well as the duration of required customer service operations. It is advantageous therefore to attempt to keep the number of separate customer replaceable units to a minimum, preferably to only one.

Additionally, in such printers, (especially color ones) where a RAM system is required for reliable fuser operation, differences in service intervals among the different parts or elements of the machine and of the fuser or fusing apparatus of the printer, present service and cost effectiveness problems. For example, the rolls 42, 44 of the fusing apparatus may be projected to last between 50 k–100 k copies or imprints. However, the oil or release agent supply 108 of the RAM system 110 for the fusing apparatus 41 is ordinarily not likely to be able to make this type of life (between 50 k–100 k copies or imprints). This is particularly so because the customer handling requirements for the fusing apparatus (i.e. small size and low cost) usually would not allow room or capacity for carrying the approximately one liter of oil or release agent required to make the 50–100 k life.

Such room or capacity requirements are made even worse if the oil or release agent must be saturated in a wick 120 in the RAM system 110 in order to facilitate low cost handling and effective sealing within a customer replaceable unit. Ordinarily, such room and capacity requirements would generally result in the use of an undesirable separate oil or release agent supply customer replaceable unit, in multiple refilling operations, for example, at frequent intervals of about 10 k copies or imprints.

Where additional oil or release agent is contained within a wick 116 inside of the main, photoreceptor CRU 100, as shown, the CRU preferably includes the openable access such as a trap door 114. As such, when the CRU 100 is inserted into in the machine 8, the trap door 114 is opened to connect the wick 116 in the CRU with a second wick 120 in the RAM system of the fusing apparatus 41. The oil or release agent 108 will thus flow slowly between the two wicks, from 116 to 120. The oil is contained within the two wicks in order to make sealing easier. A preferred machine architecture for use with the present invention is a top transfer machine architecture as shown in FIG. 1 in which the fuser release oil assembly 106 and the RAM system 110, are on the bottom.

As can be seen, there has been provided a Customer Replaceable Unit (CRU) for use in a toner powder marking technology reproduction machine including a fuser apparatus for fusing toner images. The CRU includes a housing having an external surface contoured for inserting into a CRU cavity within the reproduction machine, and elements of the reproduction machine, not including the fuser apparatus, requiring occasional. The CRU importantly includes a fuser release agent supply assembly connected to the housing thereof for supplying fuser release agent to the fuser apparatus. The fuser release agent supply assembly includes an agent reservoir located within the housing for containing fuser release agent, and an openable access door formed through a portion of the housing into the agent reservoir for releasing fuser release agent from the reservoir.

While this invention has been described in conjunction with a particular embodiment thereof, it shall be evident that many alternatives, modifications and variations will be apparent to those skilled in the art. Accordingly, the present invention is intended to embrace all such alternatives, modifications and variations as fall within the spirit and broad scope of the appended claims.

I claim:

1. A non-fuser apparatus Customer Replaceable Unit (CRU) for use in a toner powder marking technology reproduction machine including a fuser apparatus for fusing toner images, the non-fuser apparatus CRU comprising:

(a) a housing having an external surface contoured for inserting into a CRU cavity within the reproduction machine;

(b) elements of the reproduction machine requiring occasional replacement, said elements not including the fuser apparatus; and (c) a fuser release agent supply assembly forming a part of said housing for supplying fuser release agent to the fuser apparatus, said fuser release agent supply assembly including:

(i) an agent reservoir located within said housing for containing fuser release agent; and (ii) an openable access door formed through a portion of said housing into said agent reservoir for releasing fuser release agent from said reservoir.

2. The non-fuser apparatus CRU of claim 1, wherein said access door is automatically openable as said non-fuser apparatus CRU is being inserted into the CRU cavity of the reproduction machine.

3. The non-fuser apparatus CRU of claim 2, wherein said access door is a trap door.

4. The non-fuser apparatus CRU of claim 1, wherein said fuser release agent supply assembly includes an agent holding wick within said reservoir.

5. The non-fuser apparatus CRU of claim 1, wherein said fuser release agent comprises fuser release oil.

6. A release agent management (RAM) system for applying release agent to a fuser roll in an electrostatographic reproduction machine, the RAM system comprising:

(a) a fuser release agent container holding a quantity of fuser release agent and having an openable and closeable access therethrough for replenishing with fresh fuser release agent;

(b) a donor member mounted into contact with fuser release agent within said fuser release agent container and into agent-applying contact with the fuser roll in the electrostatographic reproduction machine; and (c) a fuser release agent supply assembly for supplying fresh replenishment fuser release agent to said fuser release agent container; said fuser release agent supply assembly including a housing forming an integral part of a photoreceptor customer replaceable unit within the machine, said housing defining a chamber holding a supply of fresh replenishment fuser release agent, and including an openable and closeable access that is automatically openable to supply fuser release agent to said fuser release agent container upon insertion of a Customer Replaceable Unit (CRU) into a CRU cavity within the electrostatographic reproduction machine.

7. An electrostatographic reproduction machine comprising:

(a) a machine frame;

(b) means, including a photoreceptor customer replaceable unit (CRU), for forming and transferring a toner image onto a substrate;

(c) a fusing apparatus including a heated fuser roll for heating and fusing a toner image onto the substrate; and (d) a release agent management (RAM) system for applying fuser release agent onto said heated fuser roll, said RAM system including:

(i) a fuser release agent container holding a quantity of fuser release agent and having an openable and closeable access therethrough for replenishing with fresh fuser release agent;

(ii) a donor member mounted into contact with fuser release agent within said fuser release agent container and into agent-applying contact with the fuser roll in the electrostatographic reproduction machine; and (iii) a fuser release agent supply assembly for supplying fresh replenishment fuser release agent to said fuser release agent container; said fuser release agent supply assembly including a housing forming an integral part of said photoreceptor customer replaceable unit within the machine, said housing defining a chamber holding a supply of fresh replenishment fuser release agent, and including an openable and closeable access automatically openable to supply fuser release agent to said fuser release agent container upon insertion of the CRU into a CRU cavity within the electrostatographic reproduction machine.

* * * * *